US009409386B2

(12) United States Patent
Telljohann

(10) Patent No.: US 9,409,386 B2
(45) Date of Patent: Aug. 9, 2016

(54) METHOD FOR CLEANING A COLOR SYSTEM OF A ROTARY PRINTING PRESS AS WELL AS COLOR SYSTEM

(71) Applicant: Windmoeller & Hoelscher KG, Lengerich (DE)

(72) Inventor: Lutz Telljohann, Lengerich (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 0 days.

(21) Appl. No.: 14/398,218

(22) PCT Filed: Mar. 21, 2013

(86) PCT No.: PCT/EP2013/055874
§ 371 (c)(1),
(2) Date: Oct. 31, 2014

(87) PCT Pub. No.: WO2013/164128
PCT Pub. Date: Nov. 7, 2013

(65) Prior Publication Data

US 2015/0174893 A1 Jun. 25, 2015

(30) Foreign Application Priority Data

May 2, 2012 (DE) ..... 10 2012 103 851

(51) Int. Cl.

| | |
|---|---|
| ***B41F 35/00*** | (2006.01) |
| ***B41F 31/02*** | (2006.01) |
| ***B41F 31/08*** | (2006.01) |
| ***B41F 31/20*** | (2006.01) |
| ***B41F 35/04*** | (2006.01) |

(52) U.S. Cl.
CPC ..... *B41F 35/00* (2013.01); *B41F 31/027* (2013.01); *B41F 31/08* (2013.01); *B41F 31/20* (2013.01); *B41F 35/04* (2013.01)

(58) Field of Classification Search
CPC ..... B41F 35/00
USPC ..... 101/424
See application file for complete search history.

(56) References Cited

U.S. PATENT DOCUMENTS 5,213,044 A * 5/1993 Elia ..... B41F 31/08 101/366
5,367,982 A * 11/1994 DeMoore et al. ..... 118/46

(Continued)

FOREIGN PATENT DOCUMENTS

| | | |
|---|---|---|
| DE | 19516456 | 11/1996 |
| DE | 19548535 | 7/1997 |

(Continued)

*Primary Examiner* — Anthony Nguyen
(74) *Attorney, Agent, or Firm* — Jacobson Holman, PLLC.

(57) ABSTRACT

A color system of a rotary printing press includes a doctor blade device with a doctor blade chamber containing ink for a printing process, an ink reservoir from which ink is supplied to the doctor blade chamber, and a supply system which allows ink to be supplied inside the color system. The color system is connected to a storage reservoir into which ink from the color system is introduced, to a solvent reservoir containing solvent for cleaning the color system, and to a refuse container into which ink soiled by the solvent is introduced. The supply system cleans the color system by automatically pumping off ink to the storage reservoir, and automatically cleaning with the solvent, by collecting the ink in the ink reservoir and supplying the solvent to the refuse container.

16 Claims, 5 Drawing Sheets

(56) References Cited

U.S. PATENT DOCUMENTS

| | | | | |
|---|---|---|---|---|
| 5,402,724 | A * | 4/1995 | Yaeso et al. | 101/424 |
| 5,797,328 | A * | 8/1998 | Lippold | B01D 17/0208 101/423 |
| 5,816,163 | A | 10/1998 | Achelpohl et al. | |
| 6,857,367 | B2 * | 2/2005 | Heller | B41F 23/08 101/424 |
| 2003/0167949 | A1 * | 9/2003 | Kersch et al. | 101/425 |
| 2004/0123758 | A1 * | 7/2004 | Shields | 101/350.5 |
| 2005/0103217 | A1 * | 5/2005 | Biasini | 101/425 |
| 2010/0295892 | A1 * | 11/2010 | Riera Garriga | B41F 35/04 347/28 |

FOREIGN PATENT DOCUMENTS

| | | |
|---|---|---|
| EP | 0338403 | 10/1989 |
| WO | WO 03/091027 | 11/2003 |

* cited by examiner

METHOD FOR CLEANING A COLOR SYSTEM OF A ROTARY PRINTING PRESS AS WELL AS COLOR SYSTEM

CROSS-REFERENCE TO RELATED APPLICATION

This application is a U.S. national stage application of PCT/EP13/055874.

BACKGROUND OF THE INVENTION

1. Field of Invention

The invention relates to a method for cleaning a color system of a rotary printing press as well as a color system for a rotary printing press.

2. Description of the Prior Art

A method is described in U.S. Pat. No. 5,402,724 which, upon conclusion of the print job of a rotary printing press, cleans the doctor device, particularly its ink reservoir, from any and all ink residue. It is disadvantageous here that essential supply line and drainage line of the above-mentioned device are not considered in this cleaning process, so that ink residue remains uncleansed within the device in all areas.

DE 195 48 535 A1 discusses this problem and attains it such that the solvent is conveyed from the solvent container into the doctor device and simultaneously the drainage lines and supply lines are rinsed with said solvent. Additionally, a refuse container is provided which then can accept the solvent soiled with ink.

SUMMARY OF THE INVENTION

The objective of the present invention is attained through all the features thereof described herein. Other embodiments of the invention are also described herein.

The objective of the present invention is attained in all features of claim 1. The dependent claims describe potential embodiments. Furthermore, the above-mentioned objective is attained in all features of the independent claim 12. The dependent device claims describe potential embodiments.

According to the invention, a method is provided for cleaning a color system of a rotary printing press, with the color system comprising a doctor device with a doctor chamber, containing the ink for the printing process of a rotary printing press, an ink reservoir from which ink can be conveyed into the doctor chamber, and a conveyance system, which allows the conveyance of ink within the color system. Here, according to the invention the color system is connected to a storage container, into which ink from the color system can be introduced, a solvent container, in which the solvent is located for cleaning the color system, as well as a refuse container, into which the solvent soiled with ink can be introduced. Further, the conveyance system is embodied such that the following processing steps are performed for cleaning the color system:

A: automatically pumping the ink off the color system via the conveyance system into the storage container;

B: automatically cleaning the color system via the solvent, with in a first cleaning step the solvent being collected in the ink reservoir, and in a second cleaning step the solvent being conveyed into the refuse container.

An essential advantage of the invention is the fact that, for example, in the event of a printing job being concluded or the color of the ink being changed, initially an automatic process of pumping the ink out of the color system occurs, with the ink being pumped into a separate storage container. This means that the ink is conveyed from the doctor device, particularly from the doctor chamber, into the storage container. Simultaneously a conveyance occurs or a process of pumping the ink out of the ink reservoir via the conveyance system into the storage container. The ink, which is present in the conveyance system, is also pumped into the storage container. After the step of pumping off, e.g. the storage container with the ink pumped out of the color system can be dissolved by the color system for storage purposes and stored at a different location. After the ink has been removed from the color system an automatic cleaning of the color system occurs, because always some ink residue remains within the color system, particular in the doctor chamber, the ink reservoir, as well as within the conveyance system. In this context, in the first cleaning step it occurs that the solvent is first pumped out of the solvent container via the conveyance system into the doctor chamber. In this first cleaning step another conveyance occurs of the solvent from the doctor chamber into the ink reservoir. After a defined period of time and/or after a defined volume flow of the solvent, which is conveyed by the conveyance system via the doctor chamber into the ink reservoir, this first cleaning step is concluded. The solvent is therefore collected in the ink reservoir, with simultaneously the ink reservoir also being cleaned by the collection of the solvent in the ink reservoir. Subsequently, in the second cleaning step the solvent is pumped off and/or removed, which is present in the ink reservoir and is already soiled and/or enriched with ink, into the refuse container connected to the conveyance system, with the conveyance system being switched such that the solvent already enriched with ink is conveyed by the conveyance system in the direction towards the refuse container, however this solvent cannot flow into the doctor chamber of the doctor device. This serves the purpose that the doctor chamber, already cleaned by the clean solvent, is not unnecessary soiled again by the solvent enriched with ink. Subsequently, the color system which has come into contact with the solvent enriched with ink is rinsed with clean solvent (in the direction towards the refuse container).

It is particularly advantageous that both processing steps, thus the process of pumping the ink off the storage container and the cleaning of the color system via solvent, are performed automatically. Thus, no operating personnel is required manually initiating and/or ending the processing step of pumping off the ink and/or the processing step of cleaning the color system via the solvent.

Advantageously, in the first cleaning step the doctor chamber, the ink reservoir, and at least partially the conveyance system can be cleaned. An almost complete cleaning of the color system can be achieved by the conveyance system according to the invention as well as the method according to the invention, with in addition to the doctor chamber and the conveyance system here the ink reservoir can also be cleaned, which in the first cleaning step serves as the collection container for the solvent. After the solvent has been conveyed out of the ink reservoir into the refuse container, new ink can flow into the cleaned ink reservoir, which can be used e.g., for the new upcoming printing job.

Further, it is possible that the conveyance system for the doctor chamber comprises a primary supply line and a primary drainage line, with the primary supply line comprising a flow pump and the primary drainage line comprising a return flow pump, with particularly a bypass line being arranged between the doctor chamber and the pumps. At its pressure side, the flow pump comprises a supply line towards the doctor chamber, with this supply line being the primary supply line, which extends between the ink reservoir and the doctor chamber. Another supply line is provided at the suction side of the flow pump, which connects the ink reservoir to the flow pump. Advantageously, the supply line may show a valve at the suction side of the flow pump, which is switched between the flow pump and the ink reservoir. The supply line at the pressure side of the flow pump may also be equipped with a valve, which is switched between the doctor chamber and the flow pump.

Additionally, it is possible that the primary drainage line comprises a drainage line, which is arranged at the suction side of the return flow pump. This drainage line may show a valve between the return flow pump and the doctor chamber. Additionally, the primary drainage line may comprise another drainage line at the pressure side of the return flow pump, with the latter drainage line perhaps showing a valve between the ink reservoir and the return flow pump. Thus, it is possible that a circuit can be provided, so that ink from the ink reservoir can be pumped by the flow pump into the doctor chamber, with subsequently it being possible that ink is conveyed back via the return flow pump into the ink reservoir. This represents the normal inking process for the doctor device, particularly the anilox roll of the rotary printing press. The valves provided between the doctor chamber and the two pumps may, for example, be switched such, particularly closed, that only one fluid flow develops from the flow pump through the bypass line in the direction towards the return flow pump. This blockage of the doctor chamber can be important, for example when the doctor chamber has already been washed with the solvent and during the removal of the solvent soiled with ink a renewed soiling of the doctor chamber by the conveyance system shall be prevented.

It is also possible for the conveyance system to provide a compressed air system, which can be activated after the second cleaning step so that compressed air is conveyed through the flow pump and the return flow pump, resulting in residual ink present in the flow pump and the return flow pump being removed, achieving a cleaning of the flow pump and the return flow pump. Here, it may be useful to introduced compressed air from 3 to 5 bars into the conveyance system in order to reliably release residual ink from both the flow pump as well as the return flow pump, which then can be conveyed into the ink reservoir. It may be advantageous to use the bypass line between the primary drainage line and the primary supply line for the cleaning of the flow pump and the return flow pump, this means that the compressed air is guided downstream the flow pump directly into the bypass line, with the emitted compressed air still being further conveyed out of the bypass line towards the return flow pump. Advantageously the valves arranged between the doctor chamber and the pumps are closed so that no compressed air can enter the doctor chamber. This way it is advantageously intended that the already cleaned doctor chamber is not resoiled with ink residue released from the pumps due to the inflowing compressed air.

Additionally, the invention may provide that the primary supply line and the primary drainage line comprise connection elements, which allow a connection to the ink reservoir and/or to the storage container. The connection elements are a part of the color system, with the connection element projecting into the ink reservoir and representing a part of the primary supply line. The other connection element is a part of the primary drainage line and also projects into the ink reservoir. During the printing process the ink flows through these connection elements as well. During a color change these connection elements also need to be cleaned from ink. On the one hand, these connection elements are cleaned and/or preliminarily cleaned during the first cleaning step due to the solvent flowing through them. An improving measure of the invention may include that the conveyance system comprises a supplementary cleaning device, which can be activated after the second cleaning step, so that the connection elements are cleaned. Here, it may be advantageous that the supplementary cleaning device supplies compressed air and/or a process solvent to the connection element. For example, it is possible that first a process solvent is pumped through the two connection elements in order to release ink residue from the connection elements. In another step, additional compressed air can be pumped and/or pressed through the connection elements in order to release residual ink and/or residual process solvent from the connection elements. The process solvent can also be introduced during the printing process in order to adjust the desired viscosity of the ink.

According to the invention, the compressed air system and/or the supplementary cleaning device can be activated manually and/or automatically started after the second cleaning step. For this purpose, a control and/or regulation may be connected to the color system and/or integrated in the color system. The control and/or regulation initiate the automatic process of pumping off the ink and the solvent as well as the respective cleaning steps, particularly through the compressed air system and/or through the supplementary cleaning device.

Additionally, the method according to the invention includes that the conveyance system comprises a detection means, which during the step A) detects when the ink reservoir is empty and/or nearly empty, particularly that the detection means is a sensor element, which is arranged in the primary supply line and/or integrated in the flow pump and/or the return flow pump. Additionally, the detection means can be used for the purpose of detecting during the step B), namely during the process of pumping the solvent out of the ink reservoir, when and/or if the ink reservoir is free from solvent and/or almost free from solvent. This means that the detection means can detect during the step B) when the ink reservoir is empty and/or nearly empty due to the solvent being pumped off in the direction of the refuse container. For example, it is possible that the sensor element is a frequency sensor, which determines particularly the flow rate of the flow pump and/or the return flow pump.

It may also be provided that the detection means is arranged in the primary drainage line and/or integrated in the return flow pump, with the function of the detection means being identical to the one described in the previous paragraph. Additionally, it may be provided that the detection means of the primary drainage line detects when the doctor chamber is empty and/or nearly empty.

In another advantageous measure of the invention, the method may be designed such that the conveyance system comprises an ink tempering, which is arranged particularly in the primary drainage line. The ink tempering may e.g. represent a heat exchanger, which is arranged at the pressure side of the return flow pump. Advantageously the heat exchanger is embodied as a counter flow—heat exchanger, with particularly heated water flow being guided opposite the direction of flow of the ink in the primary drainage line. A defined ink tempering occurs by heat dissipation of the water towards the ink, which is necessary during the printing process of rotary printing presses in order to allow high quality color printing. This way the viscosity of the ink can also be adjusted.

Further, the invention includes a color system for a rotary printing press, with the color system comprising a doctor device with a doctor chamber, in which ink is contained for the printing process of the rotary printing press, an ink reservoir, from which ink can be conveyed into the doctor chamber, and a conveyance system, which allows a conveyance of the ink within the color system. According to the invention, the color system is connected to a storage container, into which ink can be introduced from the color system, with a solvent container, in which solvent can be located for cleaning the color system, as well as a refuse container, into which solvent soiled with ink can be introduced. The conveyance system is embodied such that an automatic process of pumping ink via the conveyance system out of the color system into the storage container can be performed. According to the invention, after the process of pumping off, an automatic cleaning of the color system can be performed using solvent, with it being possible in a first cleaning step to collect the solvent in the ink reservoir. In a second cleaning step, the solvent can then be conveyed out of the ink reservoir via the conveyance system into the refuse container.

Advantageously, the conveyance system is designed modularly, forming an assembly, which can subsequently be connected to the color system or is separate from said color system.

Additionally, it may be provided that a sensor is arranged in the primary supply line, which determines and/or can determine the viscosity of the ink conveyed through the primary supply line from the ink reservoir to the doctor chamber. The sensor may be an ultrasound sensor. A temperature sensor may also be integrated in the viscosity sensor.

Advantageously, the solvent located in the solvent container is different from the solvent used in the supplementary cleaning device. For example, the solvent of the supplementary cleaning device may be a process solvent which represents for example pure ethanol. The solvent of the solvent container may be a cleaning solution, however, which for example is a mixture perhaps showing ethanol as one of its ingredients.

BRIEF DESCRIPTION OF THE DRAWINGS

Additional advantages, features, and details of the invention are discernible from the following description, in which an exemplary embodiment of the invention is described in detail with reference to the drawings. Here, the features mentioned in the claims and the description may be essential for the invention individually as well as in any arbitrary combination. It shows:

DETAILED DESCRIPTION OF THE PREFERRED EMBODIMENTS

Figure 1:
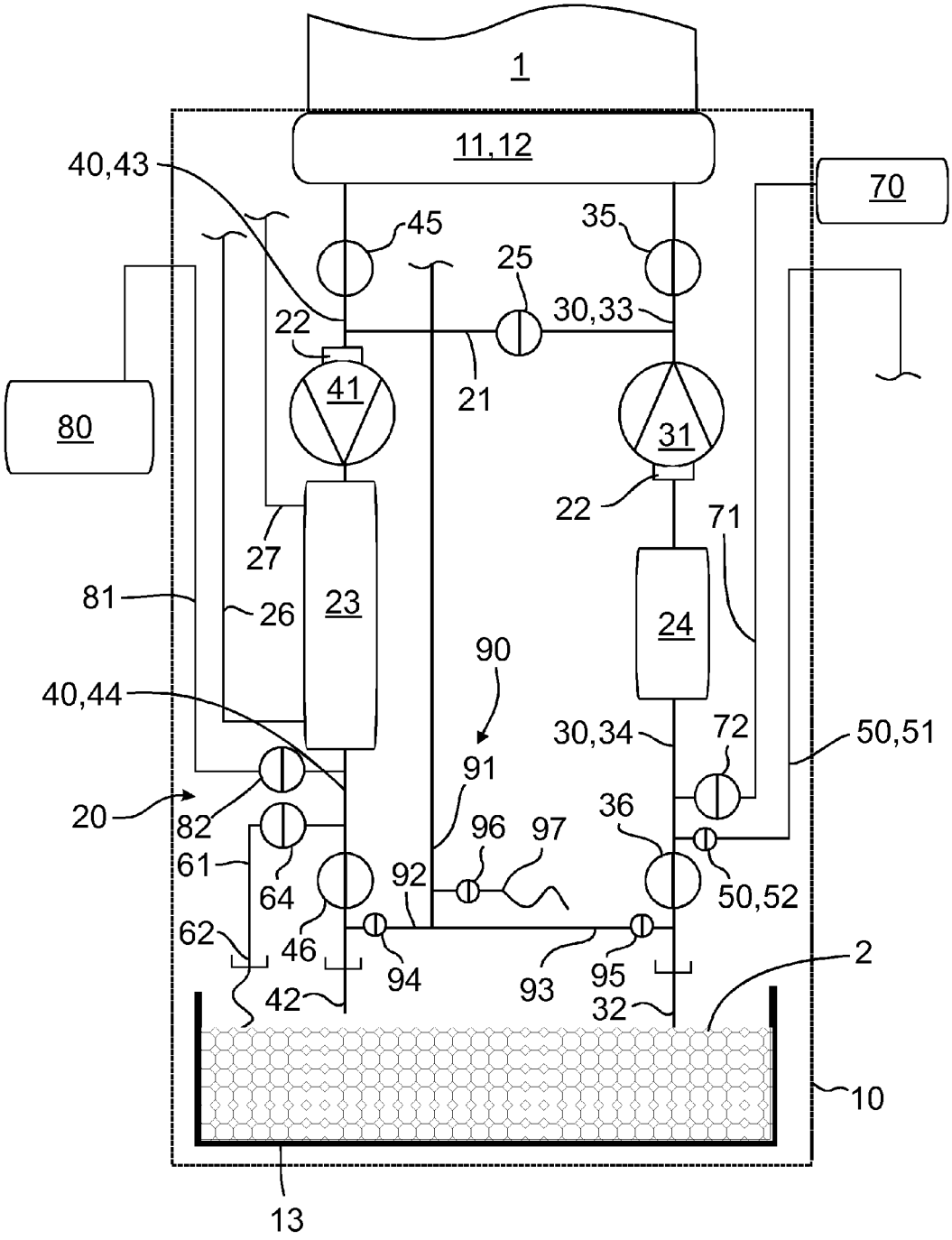
FIG. 1 a color system for a rotary printing press in which a doctor device is inked in its doctor chamber, FIG. 2 the color system according to FIG. 1, which is prepared for an automatic process of pumping off the ink located in the color system, FIG. 3 the color system according to FIG. 1, in which the ink is pumped out of the color system into a storage container, FIG. 4 a color system according to FIG. 1, with the color system being cleaned by a solvent and the solvent initially being collected in an ink reservoir of the color system, and FIG. 5 a color system according to FIG. 1, with the solvent located inside the ink reservoir being pumped out of the color system into the refuse container.
Figure 2:
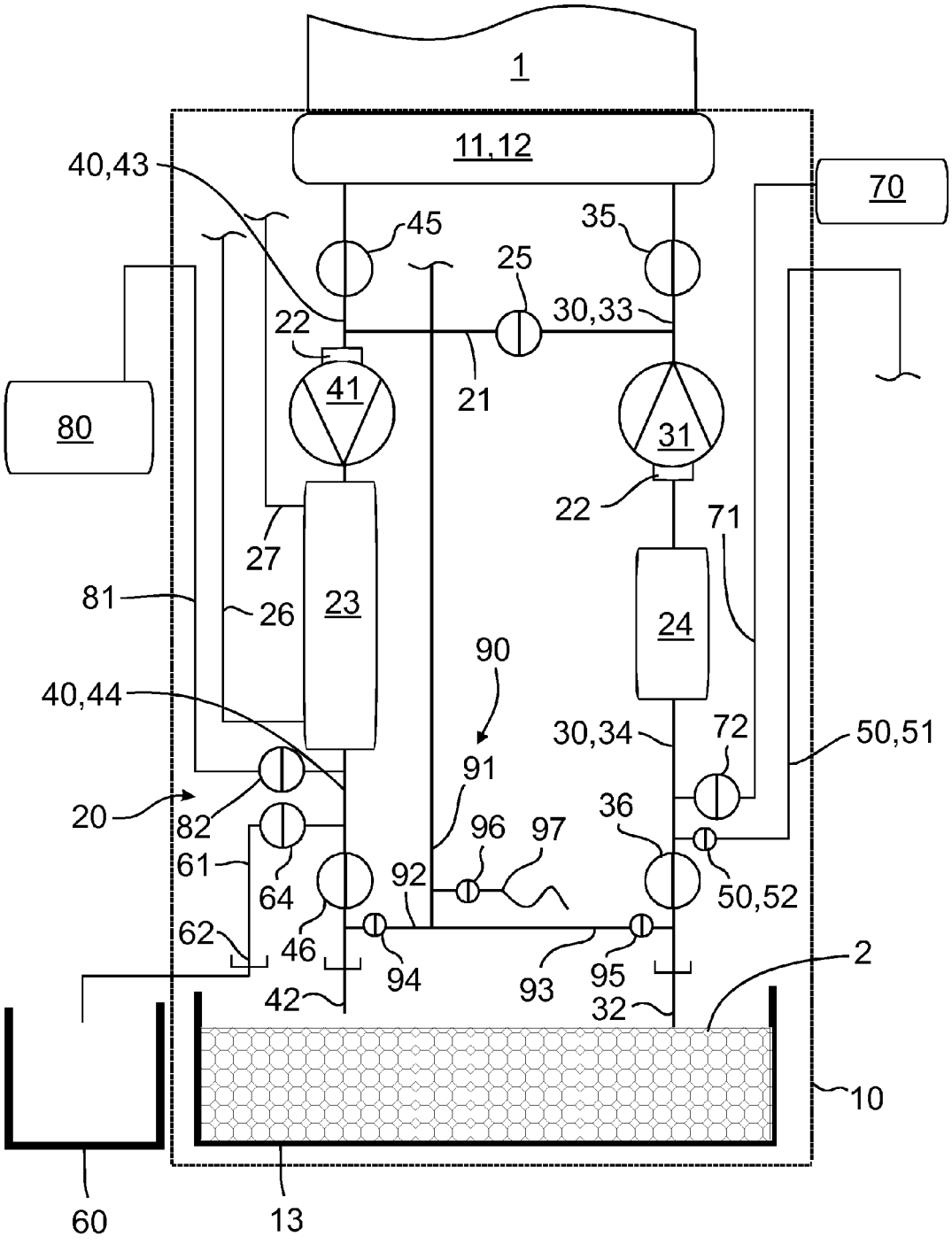

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIGS. 1 to 5 show a potential exemplary embodiment of a color system 10, which is arranged in a rotary printing press 1. Here, the color system 10 primarily serves to supply the doctor device 11 with the respective ink 2 during the printing process of the rotary printing press 1. The doctor device 11 comprises here a doctor chamber 12, in which the respective ink quantity is provided by the color system 10. Via the respective embodiment of the doctor device 11 ink 2 is conveyed from the doctor chamber 12 to a respective printing unit ensuring the print operation of the rotary printing press 1.

In order to provide ink 2 during the normal printing process, the color system 10 comprises an ink reservoir 13, in which the ink 2 is located. Additionally, a conveyance system 20 is located between the doctor device 11 and the ink reservoir 13, which is a component of the color system 10. The conveyance system 20 comprises various pumps 31, 41, lines 30, 40, as well as valves, so that a circuit develops for the ink 2 out of the ink reservoir 13 to the doctor device 11 and back to the ink reservoir 13. Additionally, the color system 10 is connected to a storage container 60, a solvent container 70, as well as a refuse container 80. During the printing process according to FIG. 1, ink 2 flows through the primary supply line 30, with here the flow pump 31 being activated and ink 2 flowing through the supply line 33, 34.

Here, the primary supply line 30 comprises two valves 35, 36, with both valves 35, 36 being open.

As discernible from FIG. 1, the conveyance system 20 comprises a bypass line 21 with a valve 25, with the bypass line 21 connecting the primary supply line 30 to the primary drainage line 40. According to FIG. 1 the valve 25 is closed, so that a circuit for the ink 2 develops only via the doctor chamber 12. During the printing process of the rotary printing press 1 the return flow pump 41 is also activated so that the drainage line 43 represents the suction side of the return flow pump 41 and the drainage line 44 represents the pressure side of the return flow pump 41. Additionally, the primary drainage line 40 shows two valves 45, 46, which are open during the printing process according to FIG. 1. The primary supply line 30 as well as the primary drainage line 40 are connected via connection elements 32, 42, also embodied as lines, to the ink reservoir 13, which means that both connection elements 32, 42 project into the ink reservoir 13 such that ink 2 can reliably flow out of the connection element 42 into the ink reservoir 13 and can be pumped out of the ink reservoir 13 via the connection element 32 into the primary supply line 30.

The primary supply line 30 comprises a viscosity sensor 24, which during the fluid flow of the ink 2 through the primary supply line 30 can determine the viscosity of said ink 2. A control and/or regulation device, not explicitly shown, is connected to the conveyance system 20 and/or the color system 10, which can adjust and/or monitor the desired viscosity of the ink 2 so that the doctor device 11 shows the optimal viscosity feature of the ink 2, which is important for the printing process and the printing quality. For example, the viscosity can be adjusted via changes of the temperature of the ink as well as the supply of additives and/or process solvents. The primary drainage line 40 comprises an ink tempering 23, which is arranged on the pressure side of the return flow pump 41. In the present exemplary embodiment, the ink tempering 23 is a heat exchanger, which shows a water supply line 26 and a water return line 27. The ink flow in the primary drainage line 40 is aligned opposite in reference to the water flow of the heat exchanger 23. Additionally, the color system 10 comprises a compressed air system 50 as well as a supplementary cleaning device 90, which is discussed in the following.

Figure 3:
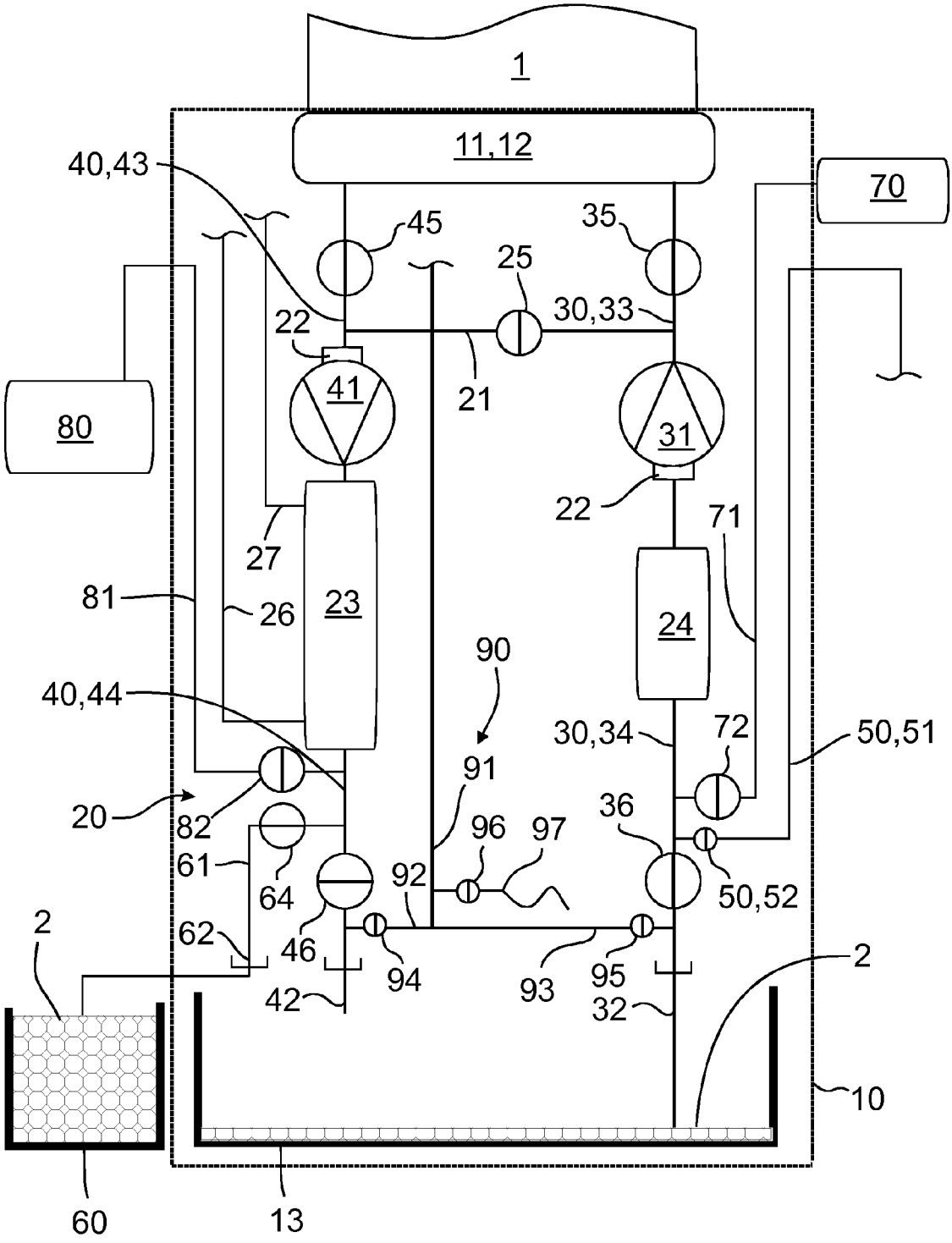
Figure 4:
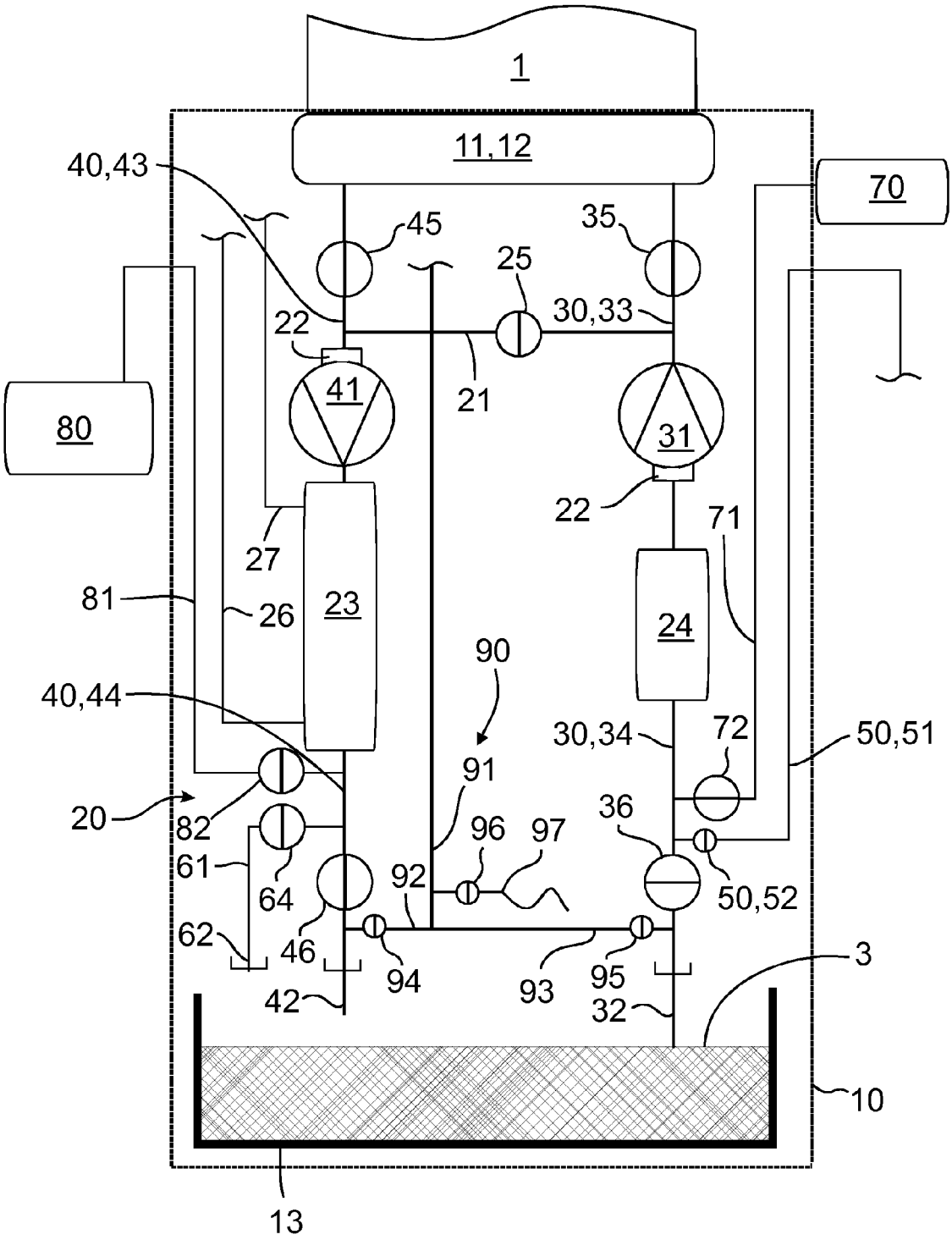

When the printing process of the rotary printing press 1 is interrupted, an automatic cleaning process of the color system 10 can occur. Among other things, it is important that any damaging drying of the ink 2 contained in the doctor device 11 is prevented. According to FIG. 2, a status analysis is shown to prepare an automatic process of pumping the ink 2 out of the color system 10, with the option being provided to convey the ink 2 into a storage container 60. The storage container 60 is connected via a connection element 62 of the color system 10 to the conveyance system 20. A line 61 with a valve 64 ensures that ink 2 can be pumped into the storage container 60, which is shown in FIG. 3. By opening the valve 64 and closing the valve 46 of the primary drainage line 40 here ink 2 reaches the storage container 60. Both pumps 31, 41 are active simultaneously. Additionally, the color system 10, particularly the conveyance system 20, comprises a detection means 22, which during the process of pumping the ink 2 out of the color system detects when the ink reservoir 13 is empty and/or nearly empty. In the present exemplary embodiment the detection means 22 is embodied as a sensor element and a frequency sensor, which is integrated in the flow pump 31. From the flow rate and/or the detection of a higher frequency of the flow pump 31 the detection means 22 can conclude that the ink reservoir 13 has been pumped almost empty. Subsequently an automatic cleaning of the color system 10 occurs using a solvent 3, which is located in the solvent container 70. By opening the valve 72 the solvent 3 flows through the line 71 and reaches the primary supply line 30, in which it is pumped by the pumps 31, 41 to the doctor device 11 as well as into the ink reservoir 13. Simultaneously the valve 36 is closed so that it is avoided that the solvent 3 flowing into the ink reservoir 13, which can be enriched with ink 2, can return into the primary drainage line 40. The solvent 3 cleans all lines 30, 40 as well as the doctor chamber 12 so that a large portion of the ink residue can be transported from the color system 10 into the ink reservoir 13.

Additionally, it is possible that another cleaning system can be activated automatically and/or manually, so that via the supply of compressed air through the line 51 another ink cleaning effect occurs within the return flow pump 41 as well as the flow pump 31.

Residual amounts of ink 2 can be released from the pumps 31, 41 by appropriately compressed air which can be subsequently transported and/or conveyed into the ink reservoir 13. The supply of compressed air occurs such that the valve 52 of the compressed air system 50 is opened, with simultaneously the valve 72 being closed. For the rest, the valve positions remain in their respective setting, which is indicated respectively in FIG. 4. If after a defined period of time the valve 52 is closed, it is possible to briefly open the valve 72 and activate the pump 41, in order to once more rinse the conveyance system 20 with solvent 3.

Figure 5:
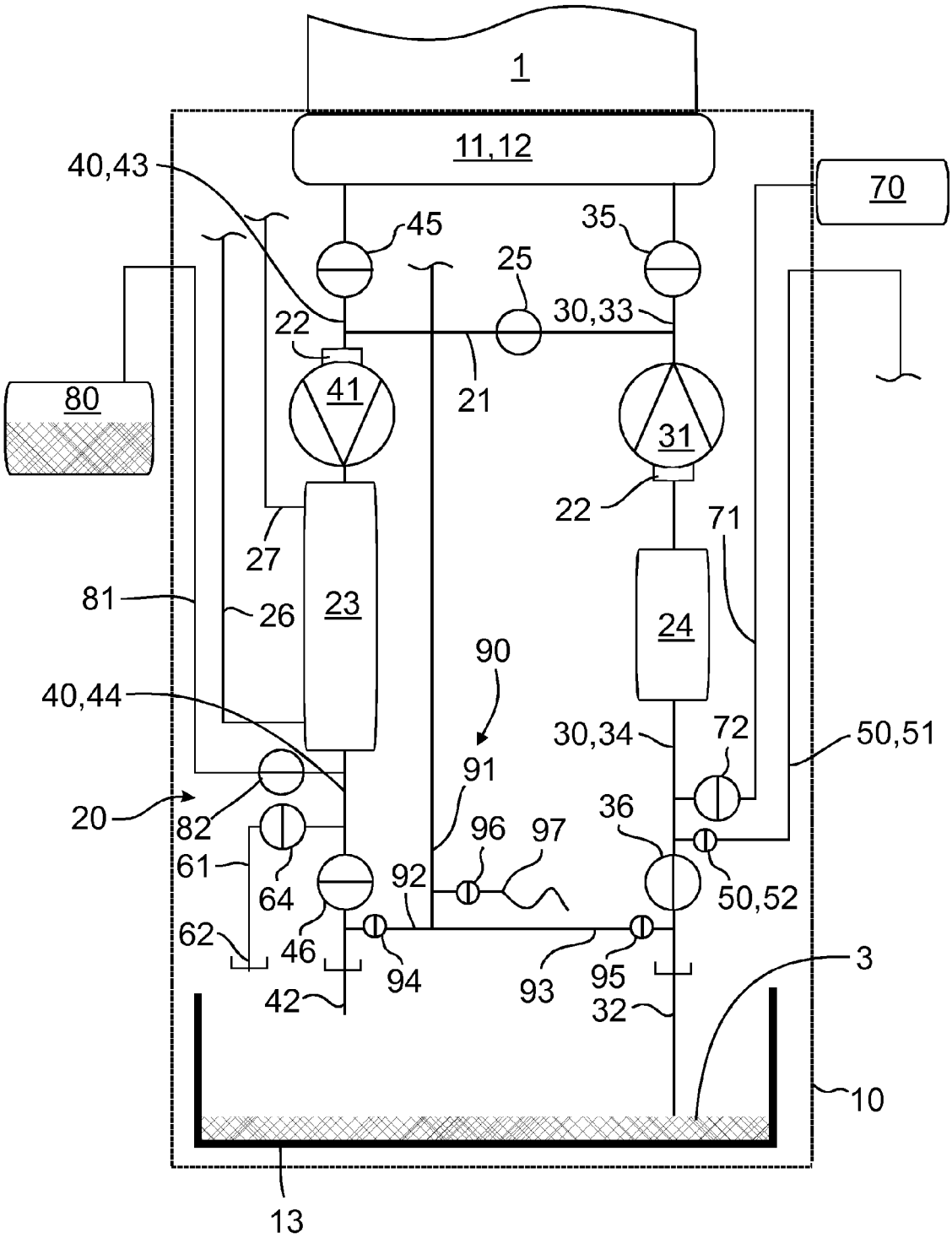

Alternatively and/or in addition to the compressed air system 50 a supplementary cleaning device 90 may be provided, which ensures that the connection elements 32, 42, 62 are cleaned, which means that ink residue is released from the above-mentioned connection elements 32, 42, 62. The supplementary cleaning device 90 comprises a line 97 with a valve 96, with it being possible in an open position of the valve 96 that compressed air can be pumped into the primary drainage line 40 and the primary supply line 30 in order to clean the connection elements 42. For this purpose the valves 94, 95 at the lines 92, 93 are opened. Simultaneously, the valves 46 and 36 are closed. Subsequently and/or alternatively another solvent can be pumped into the conveyance system 20 via the line 91, with the valve 96 being closed and the valves 94, 95 remaining open. Here, too the valves 46, 36 are closed. This solvent additionally cleans the connection elements 32, 42. It is also possible, using a line not explicitly shown, to clean the connection element 62 according to the two so-called cleaning methods (compressed air and/or solvent). After the cleaning process, now the solvent 3, which is contained in the ink reservoir 13 with ink residue 2 from the color system 10, can be pumped into the refuse container 80. This is shown in FIG. 5, with the valves 35, 45 of both primary lines 30, 40 being closed in order to prevent that the solvent 3 soiled with ink 2 can enter the doctor chamber 12. The valve 25 is open so that the solvent 3 can be pumped from the primary supply line 30 through the bypass line 21 to the primary drainage line 40. The valve 46 is also closed so that the solvent 3 is conveyed via the open valve 82 and the line 81 into the refuse container 80. It may be provided, for example, that only the pump 41 of the primary drainage line 40 is active in order to prevent that, in case of a potential leak of the valve 35, any solvent 3 can flow into the doctor chamber 12.

It is also possible to change the viscosity of the ink 2 during the printing process, using the supplementary cleaning device 90. Here, processing solvent can be mixed to the ink 2 via the line 91 as well as the open valve 94. A respective mixing occurs in the ink reservoir 13, for example using a mixer or an agitator.

It is also possible for the detection means 22 to be arranged in the primary drainage line 40, particularly the return flow pump 41, or integrated in the return flow pump 41. The functionality of this detection means 22 is equivalent to the description of the detection means 22 located at the flow pump 31. Additionally, it may be provided that the detection means 22 of the primary drainage line 40 detects when the doctor chamber 12 is empty and/or nearly empty.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of Reference Characters

| | |
|---|---|
| 1 | Rotary printing press |
| 2 | Ink |
| 3 | Solvent |
| 10 | Color system |
| 11 | Doctor device |
| 12 | Doctor chamber |
| 13 | Ink reservoir |
| 20 | Conveyance system |
| 21 | Bypass line |
| 22 | Detection means |
| 23 | Ink tempering, heat exchanger |
| 24 | Viscosity meter, viscosity exchanger |
| 25 | Valve |
| 26 | Water supply line |
| 27 | Water return line |
| 30 | Primary supply line |
| 31 | Flow pump |
| 32 | Connection element, socket |
| 33 | Supply line |
| 34 | Supply line |
| 35 | Valve |
| 36 | Valve |
| 40 | Primary drainage line |
| 41 | Return flow pump |
| 42 | Connection element, socket |
| 43 | Drainage line |
| 44 | Drainage line |
| 45 | Valve |
| 46 | Valve |
| 50 | Compressed air system |

-continued

| List of Reference Characters | |
|---|---|
| 51 | Supply line |
| 52 | Valve |
| 60 | Storage container |
| 61 | Line |
| 62 | Connection element |
| 64 | Valve |
| 70 | Container for solvent |
| 71 | Solvent supply line |
| 72 | Valve |
| 80 | Refuse container |
| 81 | Supply line |
| 82 | Valve |
| 90 | Supplementary cleaning device |
| 91 | Line |
| 92 | Line |
| 93 | Line |
| 94 | Valve |
| 95 | Valve |
| 96 | Valve |
| 97 | Line |

What is claimed is:

1. A method of cleaning a color system of a rotary printing press, with the color system including a doctor device with a doctor chamber, in which an ink for a printing process of the rotary printing press is contained, an ink reservoir from which the ink is conveyed into the doctor chamber, and a conveyance system for conveying the ink within the color system, and the color system being connected to a storage container, into which the ink from the color system is introduced, a solvent container, in which a solvent is provided for cleaning the color system, and a refuse container, into which the solvent soiled with the ink is introduced, said method comprising the following processing steps:

(A) automatically pumping the ink off the color system via the conveyance system into the storage container, while simultaneously conveying the ink out of the ink reservoir via the conveyance system into the storage container, and (B) automatically cleaning the color system via the solvent, with, in a first cleaning step, the solvent being collected in the ink container, and in a second cleaning step, the solvent being conveyed into the refuse container.

2. The method according to claim 1, wherein in the first cleaning step, the doctor chamber, the ink reservoir, and at least partially the conveyance system are cleaned.

3. The method according to claim 1, wherein the conveyance system for the doctor chamber includes a primary supply line and a primary drainage line, with the primary supply line including a flow pump, and the primary drainage line including a return flow pump, with a bypass line being arranged between the doctor chamber and the flow pump and the return flow pump.

4. The method according to claim 3, wherein the conveyance system includes a compressed air system, which is activatable after the second cleaning step such that the compressed air is conveyed through the flow pump and the return flow pump, resulting in residual ink contained in the flow pump and in the return flow pump being removed.

5. The method according to claim 3, wherein the primary supply line and the primary drainage line include connection elements, allowing a connection to at least one of the ink reservoir and the storage container.

6. The method according to claim 5, wherein the conveyance system includes a supplementary cleaning device, which is activatable after the second cleaning step to clean the connection elements.

7. The method according to claim 4, wherein the compressed air system is at least one of manually activated and automatically started after the second cleaning step.

8. The method according to claim 6, wherein the supplementary cleaning device supplies at least one of compressed air and a process solvent to the connection elements.

9. The method according to claim 3, wherein the conveyance system includes a detector, which detects during the step (A) when the ink reservoir is at least one of empty and nearly empty.

10. The method according to claim 9, wherein the detector is a sensor element that is at least one of arranged in the primary supply line and integrated in the flow pump.

11. The method according to claim 1, wherein the conveyance system includes an ink tempering device arranged in the primary drainage line.

12. A conveyance system for a rotary printing press having a color system that includes a doctor device with a doctor chamber, in which ink is contained for a printing process of the rotary printing press, and an ink reservoir from which the ink is conveyed into the doctor chamber, and a conveyance system allowing to convey ink within the color system, said conveyance system comprising:

a storage container, into which the ink is introduced from the color system, a solvent container in which a solvent is provided for cleaning the color system, and a refuse container into which the solvent soiled with the ink is introduced, with the conveyance system being configured to perform an automatic process of pumping the ink via the conveyance system off the color system into the storage container while simultaneously conveying the ink out of the ink reservoir via the conveyance system into the storage container, and perform an automatic cleaning of the color system via a solvent, with, in a first cleaning step, the solvent being collected in the ink reservoir, and in a second cleaning step, the solvent being conveyed into the refuse container.

13. The conveyance system according to claim 12, wherein the conveyance system is configured modularly, forming a structural unit, which is connectable subsequently with the color system or removable from the color system.

14. A cleanable color system including a doctor device with a doctor chamber, in which ink is contained for a printing process of a rotary printing press, an ink reservoir from which the ink is conveyed into the doctor chamber, the cleanable color system being connected to a storage container, into which the ink is introduced from the color system, a solvent container in which a solvent is provided for cleaning the color system, and a refuse container into which the solvent soiled with the ink is introduced, wherein the cleaning of the cleanable color system is performed by a method according to claim 1.

15. The method according to claim 10, wherein the sensor element is a frequency sensor that determines a flow rate of the flow pump.

16. The method according to claim 6, wherein the supplementary cleaning device is at least one of manually activated and automatically started after the second cleaning step.

* * * * *